US006317040B1

(12) United States Patent
Ikeda

(10) Patent No.: US 6,317,040 B1
(45) Date of Patent: Nov. 13, 2001

(54) INTRUDER DETECTING METHOD AND APPARATUS THEREFOR

(75) Inventor: Hiroyuki Ikeda, Otsu (JP)

(73) Assignee: Optex Co., Ltd., Otsu (JP)

( * ) Notice: Subject to any disclaimer, the term of this patent is extended or adjusted under 35 U.S.C. 154(b) by 0 days.

(21) Appl. No.: 09/636,262

(22) Filed: Aug. 10, 2000

(30) Foreign Application Priority Data

Aug. 19, 1999 (JP) ..... 11-232162

(51) Int. Cl.[7] ..... G08B 19/00
(52) U.S. Cl. ..... 340/522; 340/541; 340/552
(58) Field of Search ..... 340/541, 517, 340/518, 521, 522, 551, 552, 556, 553, 555, 557; 250/349, 342, 334, 336.1, 338.1

(56) References Cited

U.S. PATENT DOCUMENTS

| | | | | |
|---|---|---|---|---|
| 4,079,361 | * | 3/1978 | Woode | 342/27 |
| 4,704,533 | | 11/1987 | Rose et al. | 250/342 |
| 4,963,749 | | 10/1990 | McMaster | 250/349 |
| 5,631,630 | * | 5/1997 | McSweeney | 340/522 |
| 5,781,108 | * | 7/1998 | Jacob et al. | 340/552 |
| 5,786,760 | * | 7/1998 | Suzuki et al. | 340/541 |
| 6,127,926 | * | 10/2000 | Dando | 340/541 |

FOREIGN PATENT DOCUMENTS

| | | |
|---|---|---|
| 0656 505 A1 | 6/1995 | (EP) . |
| 0 834 844 A1 | 4/1998 | (EP) . |
| 0 845 765 A1 | 6/1998 | (EP) . |
| 2012 092 A | 7/1979 | (GB) . |

* cited by examiner

*Primary Examiner*—Benjamin C. Lee
(74) *Attorney, Agent, or Firm*—Price and Gess

(57) ABSTRACT

A intruder detecting apparatus for detecting a intruder invading an detection area defined in, for example, a window, entrance or apron region in front of one or more wall-mounted paintings includes a first sensor 2X having an detection area 7A defined in the front side of the objects 5 and 6 to be watched and the region upwardly of those objects 5 and 6 to be watched, and a second sensor 2Y having an detection area 7B defined in the front side of the objects 5 and 6 to be watched and the region downwardly of those objects 5 and 6 to be watched. A timer-equipped logic circuit 13 is provided in at least one of the first and second sensors 2X and 2Y. The other of the first and second sensors 2X and 2Y has an output path 17 provided therein for outputting a detection signal a from a detector 10 within such sensor to an external circuit. The timer-equipped logic circuit 13 generates an warning signal b when the timer-equipped logic circuit 13 receives the detection signal a from one of the sensors 2X and 2Y, which is provided with the timer-equipped logic circuit 13, and the detection signal a, outputted through the output path 17, within a predetermined time.

11 Claims, 13 Drawing Sheets

Fig. 1A
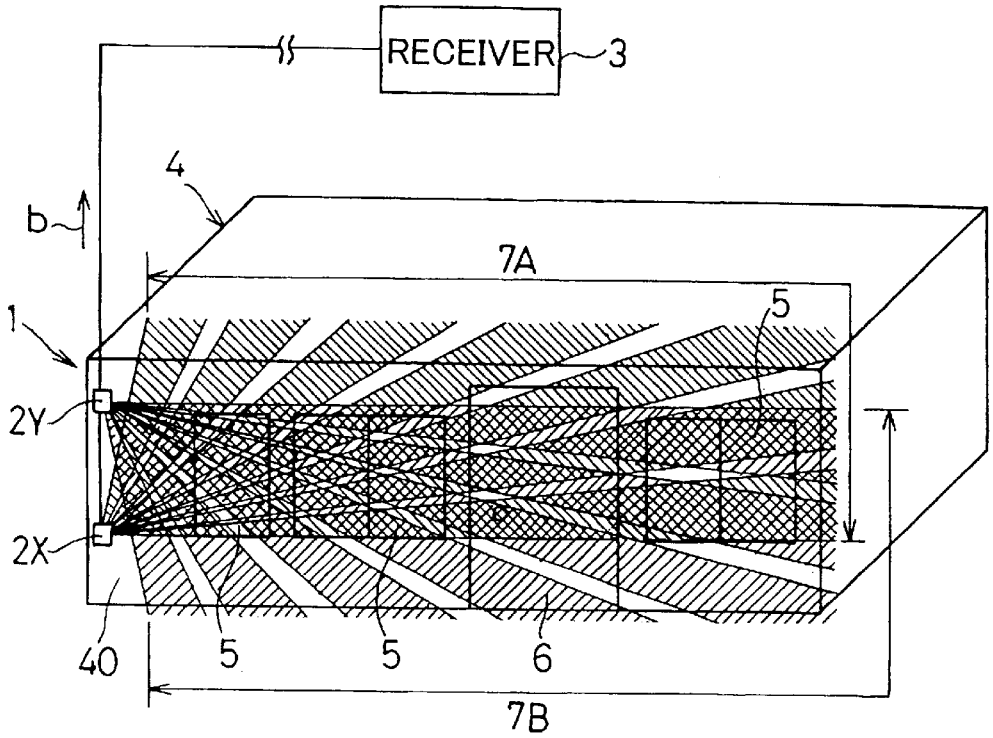
Fig. 1B
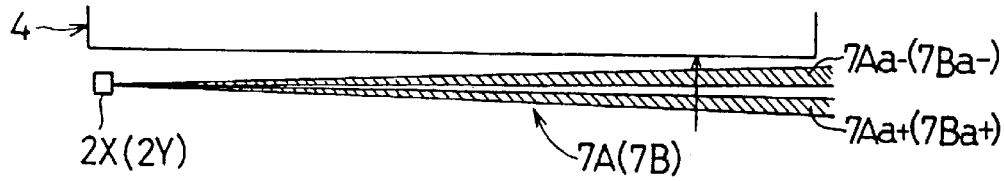
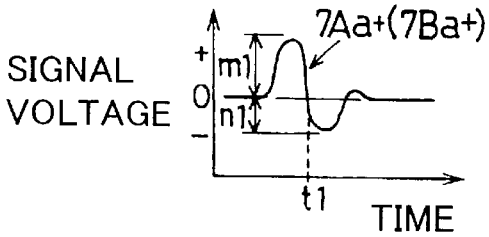
Fig. 1C
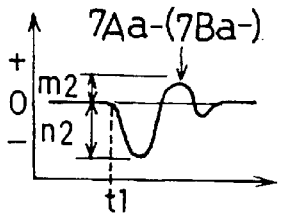
Fig. 1D
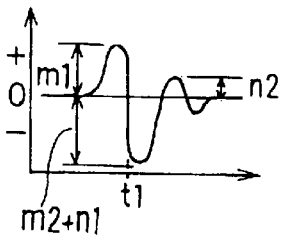
Fig. 1E

INTRUDER DETECTING METHOD AND APPARATUS THEREFOR

BACKGROUND OF THE INVENTION

1. Field of the Invention

The present invention generally relates to a intruder detecting method and an apparatus for detecting a intruder invading an detection area defined in, for example, a window, entrance or apron region in front of one or more wall-mounted paintings.

2. Description of the Prior Art

In the practice of a method of detecting and alarming intruder or approach into an detection area of a human body such as that of an invader through a window, entrance or fence of a dwelling house or warehouse or through a wall of the warehouse likely to be invaded by boring the wall, or that of a person approaching valuable paintings, it has been known to use a magnet switch, an infrared beam sensor used outdoors, or a passive type infrared (PIR) sensor used indoors adjacent the window.

FIG. 16 illustrates one of exemplary methods of detecting the intruder with the use of a magnet switch. In this example, of a magnet 52 and a reed switch 53 both constituting a magnet switch 51, the magnet 52 is fitted fixedly to a movable member such as a window 55 or a door 56 of, for example, a house 54 while the reed switch 53 is fitted fixedly to a stationary member such as a window sash or a door sash. This intruder detecting method makes use of closure or opening of the reed switch 53 that is brought about by increase or decrease of the spacing between the magnet 52 and the reed switch 53 in response to selective opening or closing of the window 55 or the door 56, respectively.

FIG. 17 illustrates one of exemplary methods of detecting the intruder with the use of the active infrared beam sensor. In this example, a light emitter 59 and a light receiver 60 altogether constituting the infrared beam sensor 58 are so installed at opposite ends of an outdoor side of a house 54 so as to allow a near infrared beam 57, emitted from the light emitter 59, to traverse in front of a window 55 and a door 56, wherefore when the near infrared beam 57 is intercepted by a intruder, the light receiver 56 can generate a detection signal. The infrared beam sensor 58 is featured in that a long distance monitoring is easy to achieve and in that it is hardly affected with change in ambient temperature, and is, therefore, often used for detection outdoors.

FIG. 18 illustrates one of exemplary methods of detecting the with the use of the PIR (Passive Infrared) sensor. In this example, the PIR sensor 61 is so configured and so installed inside a house 54 as to allow a single finger-like detection area 62 to traverse inwardly of a window 55 and a door 56 of the house 54, so that far infrared rays of light emitted by a intruder traversing the detection area 62 can be detected by the PIR sensor 61. Since the PIR sensor 62 is a sensor utilizing the principle of detection of a intruder in terms of change in temperature within the detection area, it is often used indoors to avoid any possible erroneous operation which would be triggered by an outdoor source of heat such as, for example, sunlight or automobiles.

FIG. 19 illustrates another example of the methods of detecting the intruder with the use of the PIR sensor. In this example shown in FIG. 19, the PIR sensor 61A is so configured and so installed inside a house 54 so that an area inwardly of a wall of the house 54 including a window 55 and a door 56 can be covered by a curtain-shaped detection area 63 that extends in a fashion similar to a curtain continuously in both vertical and horizontal directions, wherefore far infrared rays of light emitted by a intruder traversing the curtain-shaped detection area 63 can be detected by the PIR sensor 61A.

FIG. 20 illustrates a further example of the methods of detecting the intruder with the use of the PIR sensor. In this example, the PIR sensor 61B is so configured and so installed inside a house 54 that an area inwardly of a wall of the house 54 including a window 55 and a door 56 can be covered by a plurality of finger-like alert bands developing in a multi-staged pattern in a vertical direction to form a semi-curtain-shaped detection area 64 having a coverage generally equal to that of the curtain-shaped detection area 63, shown in FIG. 19, wherefore infra infrared rays of light emitted by a intruder traversing the semi-curtain-shaped detection area 64 can be detected by the PIR sensor 61B.

In the intruder detecting method using the magnet switch 51 as shown in FIG. 16, no intruder can be detected unless the spacing between the movable member such as the window 55 or the door 56 and the stationary member varies. Accordingly, no intruder can be detected in the event that a intruder cuts, for example, a windowpane of the window 55 to form a hole at a location remote from the site of installation of the magnet and then invades the house 54 through the hole in the windowpane. Also, with this intruder detecting method, the magnet switch 51 is required and must be installed for each of the windows 55 and the doors 56 and, therefore, if the house 54 or any other building has relatively many windows 55 and doors 56, complicated and time-consuming electric wiring is required, resulting in increase of the const for installation of the intruder detecting system.

In the intruder detecting method using the active infrared beam sensor 58 as shown in FIG. 17 wherein the near infrared beam 57 traverses in front of the window 55 and the door 56, the use of the single infrared beam sensor 58 is sufficient even where the house 54 has pluralities of windows 55 and doors 56 and, therefore, as compared with the method in which the magnet switches 51 are used, the labor required for installation of the requisite electric wiring can be considerably reduced. However, this method shown in FIG. 17 requires the near infrared beam 57 to extend linearly in front of the window 55 and the door 56, the use of the light emitter 59 for emitting the near infrared beam 57 and the light receiver 60 for receiving the near infrared beam 57 requires an accurate adjustment of the optical axis to allow the light emitter 59 and the light receiver 60 to be optically aligned with each other. Therefore, if the light emitter 59 and the light receiver 60 are spaced a substantial distance from each other, two attendant worker would be required to accomplish the requisite optical alignment adjustment, resulting in time-consuming and cumbersome labor.

Also, since in the case of this intruder detecting method, the detection area extends substantially in a line, the possibility exists in which if a intruder can locate the position at which the near infrared beam 57 travels across the window 55, the intruder will find no difficulty managing to intrude into the house through the window 55 without intercepting the near infrared beam 57 particularly where the window 55 is relatively large. To avoid this possibility and, hence, in order for this intruder detecting method to work effectively, the use of a plurality of parallel near infrared beams 57 in a staged fashion would be essential and, in such case, the number of jobs to be repeatedly performed for the optical alignment adjustment will consequently increase, resulting in a further increase of the amount of labor required.

The intruder detecting method employing the PIR sensor 61, 61A or 61B shown in FIGS. 18, 19 or 20 requires the PIR sensor 61, 61A or 61B to be merely installed at one side leftwards or rightwards of the opening and does not require a job to be performed for the optical alignment adjustment discussed above and, therefore, installation is easy and simple to accomplish. However, this intruder detecting method works to provide the intruder detection signal indicative of an unauthorized entry into the house only when and after a intruder has entered the house. Accordingly, this intruder detecting method is ineffective in that it can no way satisfy the user's requirement that a possible intruder should be detected before a potential intruder enters the house and/or that the windowpane of the window 55 should not be broken by a potential intruder.

In the example where the detection area 62 is of a finger-like shape as shown in FIG. 18, once the position at which the detection area 62 traverses is located in a manner similar to that in the case where the near infrared beam sensor 57 is employed as shown in FIG. 17, the possibility exists that a potential intruder will find no difficulty managing to intrude into the house through the window 55 without traversing the detection area 62.

Where the PIR sensor 61A or 61B are installed so that the curtain-shaped detection area 63 or the semi-curtain-shaped detection area 64 is oriented downwards as shown in FIG. 19 or 20, respectively, the possibility may exist that the PIR sensor 61A or 61B may erroneously detect a small size animal such as a rat or pet as a intruder. Where the PIR sensor 61A or 61B shown in FIG. 19 or 20, respectively, is installed outdoors so that the detection area 63 or 64 can be oriented upwards, the possibility of erroneous operation resulting from the presence of the small size animal may be eliminated, but a similar erroneous operation will occur under the influence of an external disturbance light such as sunlight or the like.

SUMMARY OF THE INVENTION

The present invention has therefore been devised to substantially eliminate the above discussed problems and is intended to provide an improved intruder detecting method and an improved apparatus therefor, which are substantially free from an erroneous operation that may be brought about by a small size animal or an external disturbance light; which are effective to accurately and correctly detect and alarming intruder or approach into an detection area of a human body such as that of an invader through a window, entrance or fence of a dwelling house or warehouse or through a wall of the warehouse likely to be invaded by boring the wall, or that of a person approaching valuable paintings; and which can be easily and inexpensively installed.

In order to facilitate understanding of the present invention devised to accomplish the foregoing object, the present invention will be described with reference to FIGS. 1A to 1E and FIG. 2 showing a mode of embodiment thereof. A intruder detecting method according to the present invention makes use of first and second sensors 2X and 2Y that are so operatively associated and so correlated with each other that only an alarm can be generated when the first and second sensors 2X and 2Y detect simultaneously within a predetermined length of time. The first sensor 2X has an detection area 7A defined in a front side of objects 5 and 6 to be watched and a region upwardly of those objects 5 and 6 to be watched, whereas the second sensor 2Y has an detection area 7B defined in the front side of the objects 5 and 6 to be watched and a region downwardly of those objects 5 and 6 to be watched.

The front side referred to above and hereinafter is intended to encompass a region in front of the objects 5 and 6 to be watched and a region spaced a somewhat distance in a horizontal direction from the front of the objects 5 and 6. More specifically, where the objects 5 and 6 to be watched are an opening in a wall and/or a fence, the front side means one side of the objects 5 and 6 to be watched that is positioned forward as viewed from an indoor or outdoor area of a house or building and, accordingly, encompasses both indoor and outdoor sides of the opening in the wall and the fence. The objects to be watched may include, in addition to the window 5 in the wall of the house or building 4, the entrance 6 and the fence, the wall itself and/or a painting. The objects to be watched may not be an entire area of the opening in the wall or the like and may be an important portion thereof excluding a small portion through which no intruder can invade or approach the object to be watched. Accordingly, the two detection areas 7A and 7B are defined at such important portion as no intruder can avoid detection, so as to overlap with each other when viewed from forward.

According to the above described intruder detecting method, only when a intruder invades or approaches an overlapping area portion of the detection area 7A established by the first sensor 2X on the front side of the objects 5 and 6 to be watched and the detection area 7B established by the second sensor 2Y on the front side of the objects 5 and 6 to be watched, the alarm can be generated, but no alarm can be generated even when detection is made at a lower region at a level below the objects 5 and 6 to be watched or at an upper region at a level above the objects 5 and 6 to be watched where the detection areas 7A and 6B do not overlap with each other. Accordingly, there is no possibility that an erroneous alarm will be generated which would be brought about by a small size animal such as a rat or pet and/or an external disturbance light such as sunlight, and the intruder of a intruder from the objects 5 and 6 to be watched and the approach of a potential intruder towards the objects 5 and 6 to be watched can be accurately detected. Even where the objects to be watched includes a plurality of openings in a single wall surface of the building, the installation of the two sensor 2X and 2Y is effective to provide the detection areas encompassing the whole openings. Also, since no delicate optical adjustment for aligning the optical axes are required, thereby facilitating installation thereof.

A intruder detecting apparatus according to one aspect of the present invention includes a first sensor 2X having an detection area 7A defined in a front side of objects 5 and 6 to be watched and a region upwardly of those objects 5 and 6 to be watched; a second sensor 2Y having an detection area 7B defined in the front side of the objects 5 and 6 to be watched and a region downwardly of those objects 5 and 6 to be watched; a timer-equipped logic circuit 13 provided in at least one of the first and second sensors 2X and 2Y, and an output path 17 provided in at least the other of the first and second sensors 2X and 2Y for outputting a detection signal "a" from a detector 10 within such sensor to an external circuit. The timer-equipped logic circuit 13 generates an warning signal "b" when the timer-equipped logic circuit 13 receives the detection signal a from one of the sensors 2X and 2Y, which is provided with the timer-equipped logic circuit 13, and the detection signal a, which is outputted through the output path 17 of the other of the sensors 2X and 2Y, within a predetermined time.

With this intruder detecting apparatus, when a intruder invades or approaches the overlapping area portion of the detection area 7A established by the first sensor 2X on the front side of the objects 5 and 6 to be watched and the detection area 7B established by the second sensor 2Y on the front side of the objects 5 and 6 to be watched, the warning signal b can be outputted from one of the first and second sensors 2X and 2Y, but no warning signal b are generated even when detection is made at the lower region at a level below the objects 5 and 6 to be watched or at the upper region at a level above the objects 5 and 6 to be watched where the detection areas 7A and 6B do not overlap with each other. Accordingly, there is no possibility that an erroneous alarm will not be generated which would be brought about by a small size animal such as a rat or pet and/or an external disturbance light such as sunlight, and the intruder of a intruder from the objects 5 and 6 to be watched and the approach of a potential intruder towards the objects 5 and 6 to be watched can be accurately detected. Even where the objects to be watched includes a plurality of openings in a single wall surface of the building, the installation of the two sensor 2X and 2Y is effective to provide the detection areas encompassing the whole openings. Also, since no delicate optical adjustment for aligning the optical axes are required, thereby facilitating installation thereof. Moreover, if one of the first and second sensors 2X and 2Y is provided with the timer-equipped logic circuit 13, a receiver 3 which generates an alarm in response to the warning signal b may be of any known type and may be of a structure commercially available in the market and, therefore, the intruder detecting apparatus can be installed inexpensively.

The intruder detecting apparatus in one preferred embodiment of the present invention also includes an output path 17 provided in one of the first and second sensors 2X and 2Y, which is provided with the timer-equipped logic circuit 13, for outputting the detection signal a as a warning signal.

With the intruder detecting apparatus of the structure described above, design has been made that in one of the first and second sensors 2X and 2Y which is provided with the timer-equipped logic circuit 13, the detection signal a from the detector 10 is outputted through the output path 17 and, therefore, it can be used as an ordinary sensor having no timer-equipped logic circuit 13, thereby providing a versatility.

In another preferred embodiment of the present invention, each of the first and second sensors is disposed on one side of the object to be watched.

With this intruder detecting apparatus according to another preferred embodiment of the present invention, since the first and second sensors 2X and 2Y are both installed at one side of the array of the windows 5 to be watched and are spaced not a long distance from each other, the electric wiring can further be facilitated.

Also preferably, one of the first and second sensors 2X and 2Y is disposed on one side of the object to be watched and the other of the first and second sensors is disposed on the opposite side of the object to be watched as shown in FIG. 11. In this case, by adjusting the respective positions for installation of the first and second sensors 2X and 2Y, the overlapping area portion in which the respective detection areas 7A and 7B for the first and second sensors 2X and 2Y overlap each other can be restricted as desired with respect to not only the heightwise direction of the object to be watched, but also the transverse (horizontal) direction of the object and, therefore, depending on the position of the object, the detection area can be properly and accurately defined. Also, since the first and second sensors 2X and 2Y of the same structure can be employed although one of them has to be held in a posture rotated 180° relative to the other of them, the use of two sensors of different structure is not required, and accordingly, the cost required for installation is reduced.

As shown in FIG. 8, one 2X of the first and second sensors 2X and 2Y provided with the timer-equipped logic circuit 13 may preferably include an output terminal connected with one of an output end of the timer-equipped logic circuit 13 and a switch 35. This switch 35 is operable to selectively connect one of an output signal from the timer-equipped logic circuit 13 and a detection signal a from a detector 10 to the output terminal.

Alternatively, as shown in FIG. 9, one 2X of the first and second sensors 2X and 2Y provided with the timer-equipped logic circuit 13 may alternatively include a switch 35 for selectively inputting one of a detection signal a from the other 2Y of the first and second sensors 2X and 2Y and a detection signal a from a detector 10 of the first sensor 2X to one of two input terminals of the timer-equipped logic circuit 13. In this arrangement, the other of the two input terminals of the timer-equipped logic circuit 13 is inputted with the detection signal a from the first sensor 2X.

A intruder detecting apparatus according to another aspect of the present invention, as shown in FIGS. 15 and 1A to 1E pertaining to the preferred embodiment of the present invention, includes a first sensor 22X having an detection area 7A defined in a front side of objects 5 and 6 to be watched and a region upwardly of those objects 5 and 6 to be watched; a second sensor 22Y having an detection area 7B defined in the front side of the objects 5 and 6 to be watched and a region downwardly of those objects 5 and 6 to be watched; and a receiver 23 for generating an alarm in response to a warning signal b based on detection from the first and second sensors 22X and 22Y. The receiver 23 is provided with a timer-equipped logic circuit 33 for generating the alarm only when the warning signals b are received from the first and second sensors 22X and 22Y within a predetermined time.

With the intruder detecting apparatus according to the another aspect of the present invention, when a intruder invades or approaches the overlapping area portion of the detection area 7A established by the first sensor 2X on the front side of the objects 5 and 6 to be watched and the detection area 7B established by the second sensor 2Y on the front side of the objects 5 and 6 to be watched, the warning signal b is be outputted from each of the first and second sensors 2X and 2Y and the receiver 23 in response to these warning signals b outputted within a predetermined time generates the alarm, but no warning signal b is generated even when detection is made at the lower region at a level below the objects 5 and 6 to be watched or at the upper region at a level above the objects 5 and 6 to be watched where the detection areas 7A and 6B do not overlap with each other. Accordingly, there is no possibility that an erroneous alarm will not be generated which would be brought about by a small size animal such as a rat or pet and/or an external disturbance light such as sunlight, and the intruder of a intruder from the objects 5 and 6 to be watched and the approach of a potential intruder towards the objects 5 and 6 to be watched can be accurately detected. Even where the objects to be watched includes a plurality of openings in a single wall surface of the building, the installation of the two sensor 22X and 22Y is effective to provide the detection areas encompassing the whole openings. Also, since no delicate optical adjustment for aligning the optical axes are required, thereby facilitating installation thereof. Moreover, since the receiver 3 is provided with the timer-equipped logic circuit 33, the first and second sensors 22X and 22Y may be of any known type and may be of a structure commercially available in the market and, therefore, the intruder detecting apparatus can be installed inexpensively.

A intruder detecting sensor according to the present invention, is a sensor 2X having a curtain shaped or semi-curtain shaped detection area as shown in FIGS. 2, 8 or 9 pertaining to the preferred embodiments of the present invention. The intruder detecting sensor 2X includes a timer-equipped logic circuit 13 receiving as one of input signals the detection signal a from the detector 10 within the sensor and operable to generate a warning signal b when such one of the input signals and the other of the input signals are received by the timer-equipped logic circuit 13 within a predetermined time; an input path 15 for supplying an input signal from an external circuit to the timer-equipped logic circuit 13 as the other of the input signals; and an output path 17 for outputting the detecting signal a as the warning signal b. It is to be noted that the curtain shaped detection area is intended to mean an detection area of a wall-like shape extending in a direction parallel to the vertical plane and that the semi-curtain shaped detection area is intended to mean an detection area made up of a plurality of elongated finger-like areas juxtaposed so as to extend in a direction parallel to the vertical plane, the spacing between the neighboring finger-like areas being so small that no potential intruder is unable to pass there-through.

With the intruder detecting sensor of the structure described above, if two sensors 2X and 2Y of the same structure are used, connection is possible in which the detection signal a from one of the sensors, that is, the sensor 2X provided with the timer-equipped logic circuit 13, and the detection signal a from the other sensor 2Y are supplied to the timer-equipped logic circuit 13 in the sensor 2X, and accordingly, the intruder detecting apparatus utilizing the two sensors 2X and 2Y can be simplified in structure with any commercially available existing receiver 3 used Also, since the detection signal a can be outputted as the warning signal b through the output path 17, the sensor 2X or 2Y can be used as a standard sensor utilizing no AND logic element, thereby increasing the versatility.

The intruder detecting sensor referred to above may, as shown in FIG. 8, preferably include a switch 35 for selectively outputting one of an output signal from the timer-equipped logic circuit 13 and an output signal from the detector 10 as the warning signal b.

The intruder detecting sensor may, as shown in FIG. 9, preferably include a switch 36 disposed on the input path 15 for selectively outputting such one of the input signals and an output signal from the external circuit to the timer-equipped logic circuit 13 as such other of the input signals.

It is to be noted that considering the possibility that the house or building has its roof formed with a skylight to introduce sunlight into the indoor room and/or a pet is kept indoors, the method, the apparatus and the sensor according to the present invention can be employed not only outdoors, but also indoors effectively.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

FIG. 1A is a schematic perspective view of a house showing a intruder detecting system according to a first preferred embodiment of the present invention;

FIG. 1B is a schematic plan view showing an detection area of a PIR sensor used in the intruder detecting system shown in FIG. 1A;

FIG. 1C is a diagram showing the waveform of a detection signal indicative of a intruder traversing the detection area in one condition;

FIG. 1D is a diagram showing the waveform of a detection signal indicative of a intruder traversing the detection area in another condition;

FIG. 1E is a diagram showing the waveform of a detection signal indicative of a intruder traversing the detection area in a further condition;

DETAILED DESCRIPTION OF THE EMBODIMENTS

Figure 2:
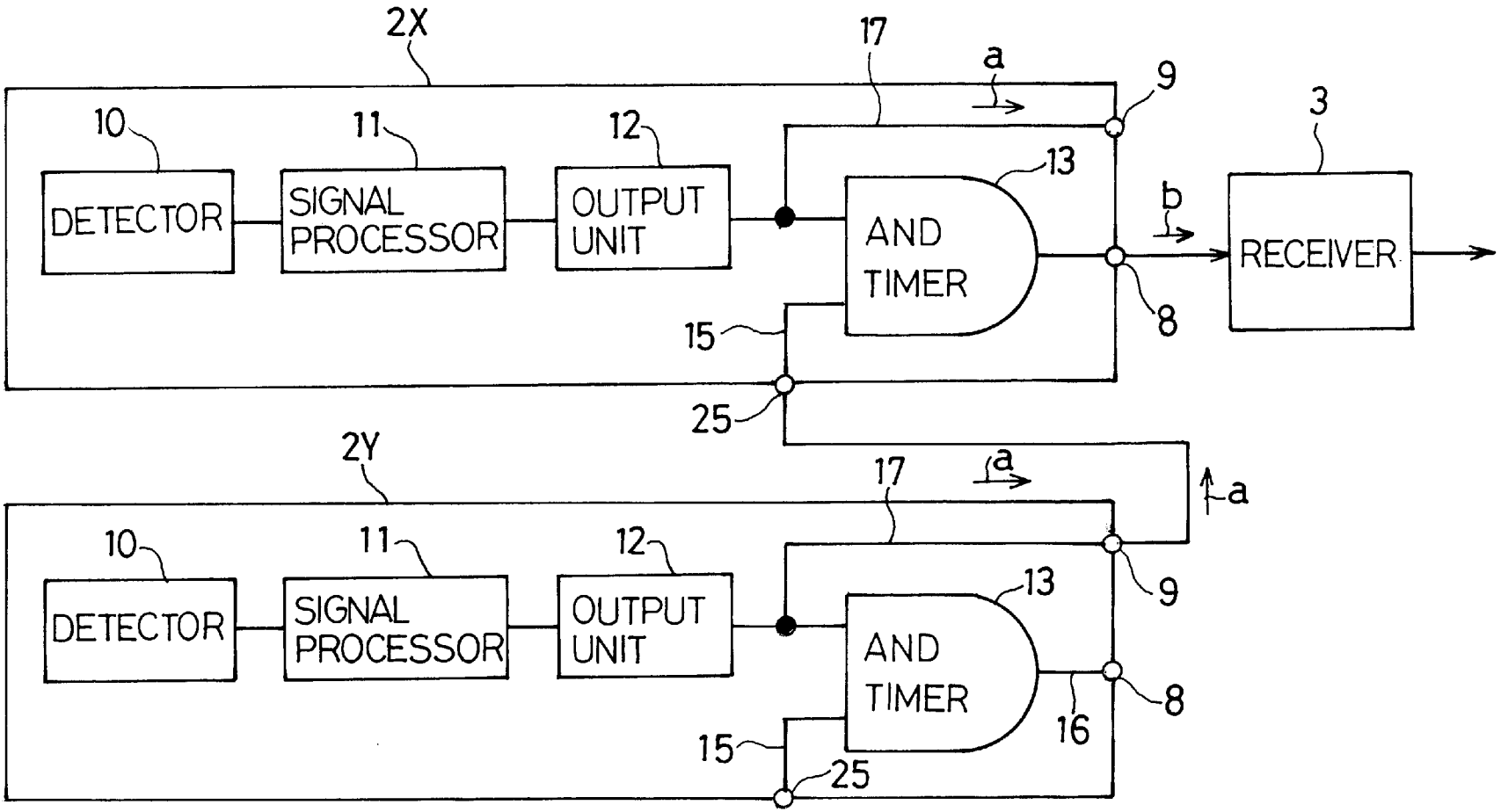
FIG. 2 is a circuit block diagram showing a intruder detecting apparatus used in the intruder detecting system shown in FIG. 1A.

Referring first to FIG. 1A, there is shown, in a schematic perspective view, a house embodying a intruder detecting system according to a first preferred embodiment of the present invention. In this intruder detecting system, a detecting apparatus 1 including first and second PIR sensors 2X and 2Y and a receiver 3 is used to detect a intruder of a potential intruder through one of openings formed in a wall of the house. The openings include, for example, windows 5 and an entrance 6 through which a intruder can enter the house.

One of these PIR sensors, for example, the first PIR sensor 2X is disposed adjacent one of opposite sides, for example, a left side as viewed in FIG. 1A, of the leftmost window 5, which is formed in the wall 40 forming a part of the perimeter of the house 4, and at a position generally level with a lower edge of the window 40, and is fixed outdoors to an outer side of the wall 40. The first PRI sensor 2X so installed has an detection area 7A of a semi-curtain shape that encompasses an outdoor surface area of the wall 40 including respective front sides of the openings including the windows 5 and the entrance 6 and an upper region of the wall 40 above the openings except for a lower region of the wall 40. The semi-curtain shaped detection area 7A in such case is intended to mean an detection area made up of a plurality of elongated finger-like areas juxtaposed so as to extend in a direction parallel to the vertical plane, the spacing between the neighboring finger-like areas being so small that no potential intruder is unable to pass therethrough.

On the other hand, the second PIR sensor 2Y is disposed adjacent the same side of the leftmost window 5 as the first PIR sensor 2X, but at an upper position generally level with an upper edge of the window 40, and is fixed outdoors to the outer side of the wall 40. This second PRI sensor 2Y so installed has an detection area 7B of a semi-curtain shape that encompasses an outdoor surface area of the wall 40 including respective front sides of the openings including the windows 5 and the entrance 6 and a lower region of the wall 40 below the openings except for the upper region of the wall 40. Although in the illustrated embodiment, an object to be watched is defined including the entire surface area of each of the windows 5 and an intermediate portion (an important portion) of the entrance 6 excluding upper and lower portions thereof, the object to be watched may be defined including a similarly important portion of each of the windows 5, excluding upper and lower portions of each window 5 which have a size that is unable for any human body to pass therethrough.

Each of the semi-curtain shaped detection areas 7A and 7B of the respective first and second PIR sensors 2X and 2Y is made up of two divided areas 7A*a*+(7B*a*+) and 7A*a*−(7B*a*−), as shown in FIG. 1B, that are divided in a horizontal direction so that when the object to be watched such as, for example, a potential intruder traverses the detection areas 7A and 7B in a direction shown by the arrow in FIG. 1B, detection of a change resulting in increase of infrared rays in the area 7A*a*+(7B*a*+) can provide an output (+m1 followed by −n1) of a positive polarity and detection of a change resulting in increase of infrared rays in the area 7A*a*−(7B*a*−) can provide an output (−n2 followed by +m2) of a negative polarity. Accordingly, as shown in FIG. 1E, design has been made to increase the sensitivity (positive amplitude +m1, negative amplitude −(m2+n1)) with respect to the object to be watched that traverses the divided areas 7A*a*+(7B*a*+) and 7A*a*−(7B*a*−) with a time lag. These detection areas 7A and 7B when viewed in a plane need not overlap with each other, that is, need not be spaced an equal distance in the horizontal direction from the objects 5 and 6 to be watched, but may be displaced in the horizontal direction from each other at a horizontal interval which is smaller than the gap through which the potential intruder can pass without being detected.

FIG. 2 illustrates an example of electric connection of the first and second PIR sensors 2X and 2Y with the receiver 3. Each of the first and second PIR sensors 2X and 2Y includes a detector 10 which may be a pyroelectric element or the like, a signal processing unit 11 for signal-processing a detection output from the detector 10, an output unit 12 for outputting the signal, processed by the signal processing unit 11 as a detection signal a, and a timer-equipped logic circuit (hereinafter referred to as an AND timer) 13 as will be described in detail later. Each of the first and second PIR sensors 2X and 2Y also includes a first output terminal 8 connected with an output terminal of the AND timer 13 through a first output path 16 for outputting an output signal from the AND timer 13 to an external circuit, and a second output terminal 9 connected with a second output path 17 for supplying the detection signal a from the output unit 12 so as to bypass the AND timer 13.

Furthermore, each of the first and second PIR sensors 2X and 2Y includes an input terminal 25 and an input path 15 for receiving the detection signal a, which is outputted through the second output path 17 of one of the first and second PIR sensors 2X and 2Y, as an input signal to be supplied to the AND timer 13 of the other of the first and second PIR sensors 2X and 2Y. The first output terminal 8 of the first PIR sensor 2X is connected with the receiver 3 to which an output signal from the AND timer 13 is supplied as a warning signal b. The first output terminal 8 of the second PIR sensor 2Y is open. Accordingly, the AND timer 13 of the second PIR sensor 2Y can be dispensed with if so desired. However, the use of the AND timer 13 in each of the first and second PIR sensors 2X and 2Y is particularly advantageous in terms of production and management since a single type of products can be used for either the first PIR sensor 2X or the second PIR sensor 2Y.

Where any one of the PIR sensors 2X and 2Y is desired to be used as a standalone PIR sensor, the first output terminal 8 has to be open and the receiver 3 has to be connected with the second output terminal 9 so that the detection signal a, which is outputted externally from the second output terminal 9 through the second output path 17 can be supplied to the receiver 3 as the warning signal b. By so doing, it can be used as a standard sensor having no AND logic circuit, allowing the sensor to have an increased versatility.

The AND timer 13 referred to above is so designed and so configured as to generate the warning signal b only when it receives the detection signal a outputted from the output unit 12 of the first PIR sensor 2X and the detection signal a outputted from the output unit 12 of the second PIR sensor 2Y within a predetermined time, for example, five seconds. The function of the AND timer 13 will be described later with particular reference to the flow chart shown in FIG. 3.

Figure 4:
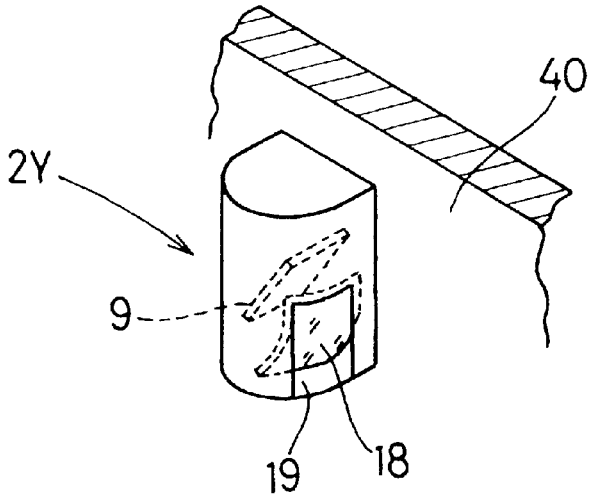
FIG. 4 is a schematic perspective view showing an example of installation of the PIR sensor forming a part of the intruder detecting apparatus.

FIG. 4 illustrates a perspective view of the second PIR sensor 2Y installed at the wall 40 of the house 4, and FIG.

Figure 5:
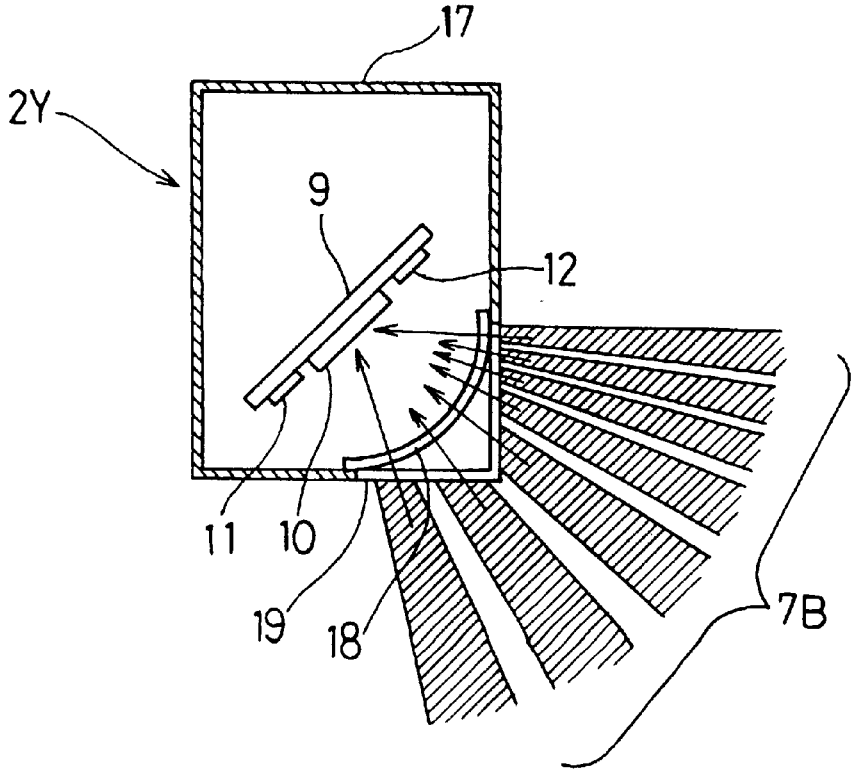
FIG. 5 is a longitudinal sectional view of the PIR sensor.

5 illustrates a longitudinal sectional representation of such second PIR sensor 2Y. This PIR sensor 2Y comprises a substrate 26 disposed within a casing 17 shown in FIG. 4 and having mounted thereon the detector 10, the signal processing unit 11 and the output unit 12, all shown in FIG. 5, as well as the AND timer 13, the second output path 17 and the input path 15 all shown in FIG. 2. The second PIR sensor 2Y also comprises a lens element 18 mounted on the casing 17 so as to cover an opening 19 defined in the casing 17. The lens element 18 may be in the form of a Fresnel lens and is operable to allow infrared rays of light from the semi-curtain shaped detection area 7B to be incident upon the detector 10 of the detecting element 8. In the case of this second PIR sensor 2Y, the PIR sensor 2Y is so mounted on the wall 40 of the house 4 in a laterally oriented posture with the opening 19 of the casing 17 oriented downwards so that the semi-curtain shaped detection area 7B can "view" downwards. The first PIR sensor 2X shown in FIG. 1 is of a structure similar to the second PIR sensor 2Y, but is so mounted on the wall of the house 4 in a laterally oriented posture with the opening 19 of the casing 17 oriented upwards so that the semi-curtain shaped detection area 7A can "view" upwards. It is to be noted that an optical system forming the semi-curtain shaped detection area 7A may not be limited to the lens element 18 and may be constituted by, for example, a reflecting mirror.

The intruder detecting operation performed by the intruder detecting apparatus 1 shown in FIG. 1 will now be described. In the event that a intruder enters into the upwardly oriented semi-curtain shaped detection area 7A defined by the first PIR sensor 2X, that is, an area along the wall of the house 4 and on the front side of at least a portion of the opening including the windows 5 and the entrance 6 and the upper portion of the wall 40 above the windows 5, excluding a lower portion of the wall 40, the detector 10 shown in FIG. 2 of the first PIR sensor 2X detects the entry of the intruder and outputs a detection output to the signal processing unit 11 which processes the detection output and render a processed signal to be a detection signal a which the output unit 12 can output to the external circuit, which detection signal a is subsequently inputted to the first input terminal of the AND timer 13.

On the other hand, in the event that a intruder enters into the downwardly oriented semi-curtain shaped detection area 7B defined by the second PIR sensor 2Y, that is, an area along the wall of the house 4 and on the front side of at least a portion of the opening including the windows 5 and the entrance 6 and the lower portion of the wall 40 below the windows 5, excluding an upper portion of the wall 40,the detector 10 shown in FIG. 2 of the second PIR sensor 2Y detects the entry of the intruder and outputs a detection output to the signal processing unit 11 which processes the detection output and render a processed signal to be a detection signal a which the output unit 12 can output to the external circuit, which detection signal a is subsequently inputted to the second input terminal of the AND timer 13 through the second output path 17 by way of the input path 15 of the first PIR sensor 2X.

In the AND timer 13 in the first PIR sensor 2X, as will be described below with reference to FIG. 3, the warning signal b is outputted depending on the timing at which the detection signal a outputted from the output unit 12 of the first PIR sensor 2X itself shown in FIG. 2 (which detection signal a is hereinafter referred to as an X signal for simplification purpose) and the detection signal a outputted from the output unit 12 of the second PIR sensor 2Y (which detection signal a is hereinafter referred to as a Y signal for simplification purpose) are inputted to the AND timer 13, which warning signal b is subsequently transmitted to the receiver 3 through the first output path 16.

Figure 3:
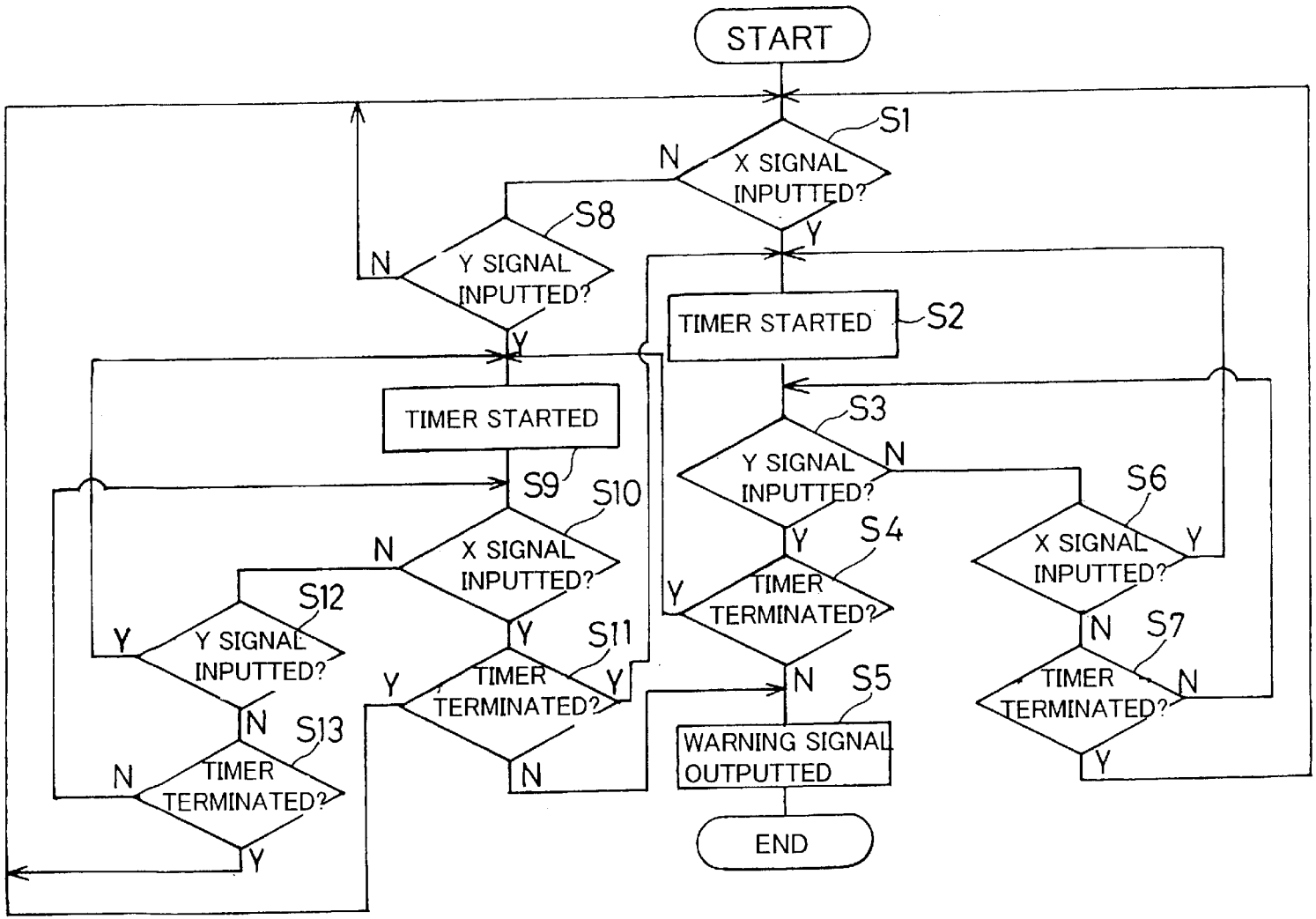
FIG. 3 is a flow chart showing the sequence of operation of a timer-equipped logic circuit (AND timer) employed in the intruder detecting apparatus.
Figure 6:
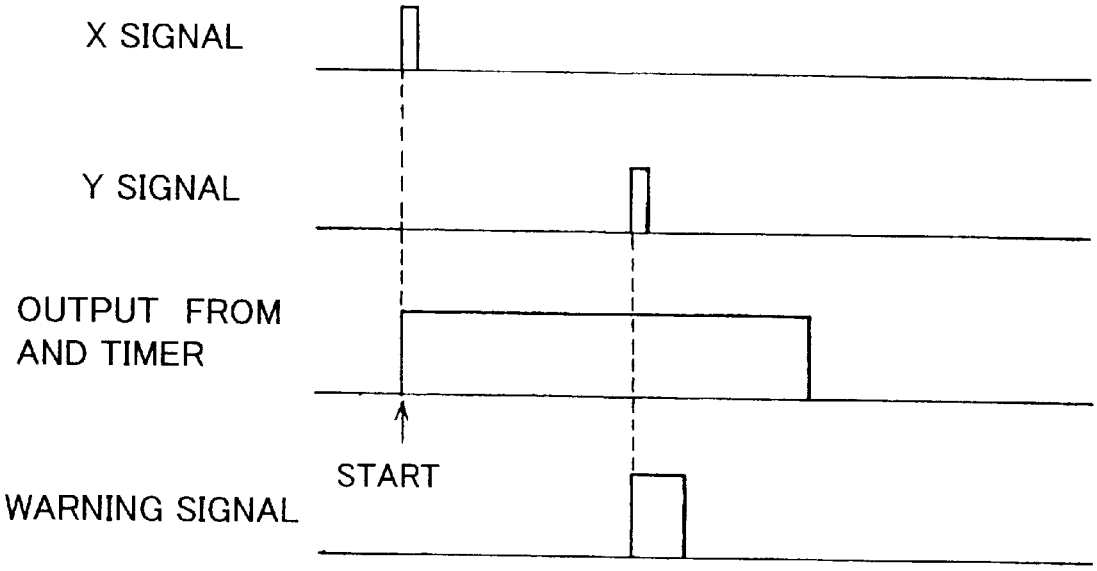
FIG. 6 is a timing chart showing an example of operation of the intruder detecting apparatus.

In other words, when the X signal, for example, is inputted as determined at step S1 shown in FIG. 3, the timer starts its counting operation at that time at step S2. When the Y signal is inputted before a predetermined time, for example, five seconds preset to the timer elapses at successive steps S3 and S4, the AND timer 13 outputs the warning signal b at step S5 and is then transmitted to the receiver 3 shown in FIG. 2 and the receiver 3 in response to the warning signal b issues an alarm. The timing chart of the various signals at this time is shown in FIG. 6.

Figure 7:
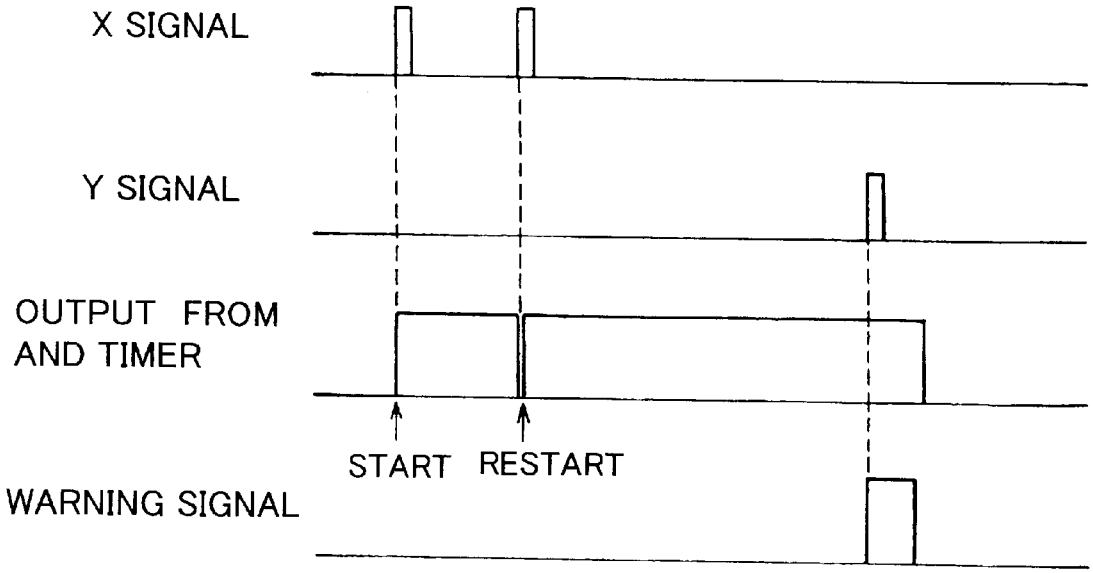
FIG. 7 is a timing chart showing another example of operation of the intruder detecting apparatus.

In the event that after the X signal has been inputted the X signal, not the Y signal, is again inputted at step S6 of FIG. 3, the timer restarts its counting operation before the predetermined time preset to the timer elapses at step S2, thereby repeating the above described operation. The timing chart of the various signals at this time is shown in FIG. 7. Should no Y signal be inputted even though the predetermined time preset to the time has elapsed at steps S3, S6 and S7, the program flow returns to step S1, followed by repetition of the above described operation.

The foregoing operation equally takes place even when the Y signal is inputted prior to the X signal. In other words, when the Y signal is first inputted at steps S1 and S8 of FIG. 3, the timer starts its counting operation at that time at step S9. When the X signal is inputted before the predetermined time preset to the timer elapses at steps S10 and S11, the AND timer 13 issues the warning signal b at step S5, which is in turn transmitted to the receiver 3 which, in response to the warning signal b, issues the alarm. However, in the event that after the Y signal has been inputted the Y signal, not the X signal, is again inputted at steps S10 and S12, the timer restarts its counting operation before the predetermined time preset to the timer elapses at step S9, thereby repeating the above described operation. Should no X signal be inputted even though the predetermined time preset to the time has elapsed at steps S10, S12 and S13, the program flow returns to step S1, followed by repetition of the above described operation.

It is, however, to be noted that if after the X signal has first been inputted, the Y signal is inputted after the passage of the predetermined time preset to the timer (steps S1 to S4 shown in FIG. 3), the program flow goes to step S9 at which the timer starts its counting operation and an operation to wait for the X signal takes place in a manner similar to that described above. Also, if after the Y signal has been inputted, the X signal is inputted after the passage of the predetermined time preset to the timer (steps S8 to S11), the program flow goes to step S2 at which the timer starts its counting operation and an operation to wait for the Y signal takes place in a manner similar to that described above.

As described hereinabove, only when the X signal, based on detection by the first PIR sensor 2X, and the Y signal based on detection by the second PIR sensor 2Y are inputted to the AND timer 13 within the predetermined time preset to the timer, the warning signal b is generated from the AND timer 13 and the receiver 3 subsequently issues the alarm. In other words, only when the intruder enters an overlapping area portion of the upwardly oriented semi-curtain shaped detection area 7A established by the first sensor 2X and the downwardly oriented semi-curtain shaped detection area 7B established by the second sensor 2Y, the receiver 3 issues the alarm. For this reason, even though second PIR sensor 2Y detects a small size animal such as, for example, a rat or a pet moving in the lower portion below the semi-curtain shaped detection area 7A established by the first PIR sensor 2X, the receiver 3 does not issue an alarm, thereby avoiding an erroneous alarming resulting from detection of the small size animal. Similarly, even when the first PIR sensor 2X detects an external disturbance light such as, for example, sunlight beaming in the upper portion above the semi-curtain shaped detection area 7B established by the second PIR sensor 2Y, the receiver 3 does not issue an alarm, thereby avoiding an erroneous alarming resulting from detection of the external disturbance light.

Since in the illustrated embodiment the first and second PIR sensors 2X and 2Y are used as a intruder detecting sensor, adjustment of respective positions for installation of the first and second PIR sensors 2X and 2Y depending on the layout of the openings such as the windows 5 and the entrance 6 of the house 4 makes it possible to easily define the overlapping area portion of the semi-curtain shaped detection areas 7A and 7B so as to overlap with the openings and, therefore, as compared with the prior art case in which the magnet switches are employed, electric wiring can easily be installed. Also, since the first and second PIR sensors 2X and 2Y are both installed at one side of the array of the windows 5 to be watched and are spaced not a long distance from each other, the electric wiring can further be facilitated. Moreover, since no optical aligning adjustment separate from the electric wiring that has hitherto been required in the prior art where the active infrared beam sensor is employed is needed, installation of the intruder detecting apparatus of the present invention can further be facilitated.

Yet, in the foregoing embodiment of the present invention, since the AND timer 13 is provided in one or both of the first and second PIR sensors 2X and 2Y, the receiver 3 that can be employed may be of any known, currently employed type and, therefore, the intruder detecting apparatus I as a whole can be assembled at a reduced cost. Moreover, since the detection signal a can be outputted as a warning signal from the second output path 17 by passing the AND timer 13 in each of the first and second PIR sensor 2X and 2Y, it can be used as a standard PIR sensor utilizing no AND logic circuit and, therefore, the versatility can be increased.

Figure 8:
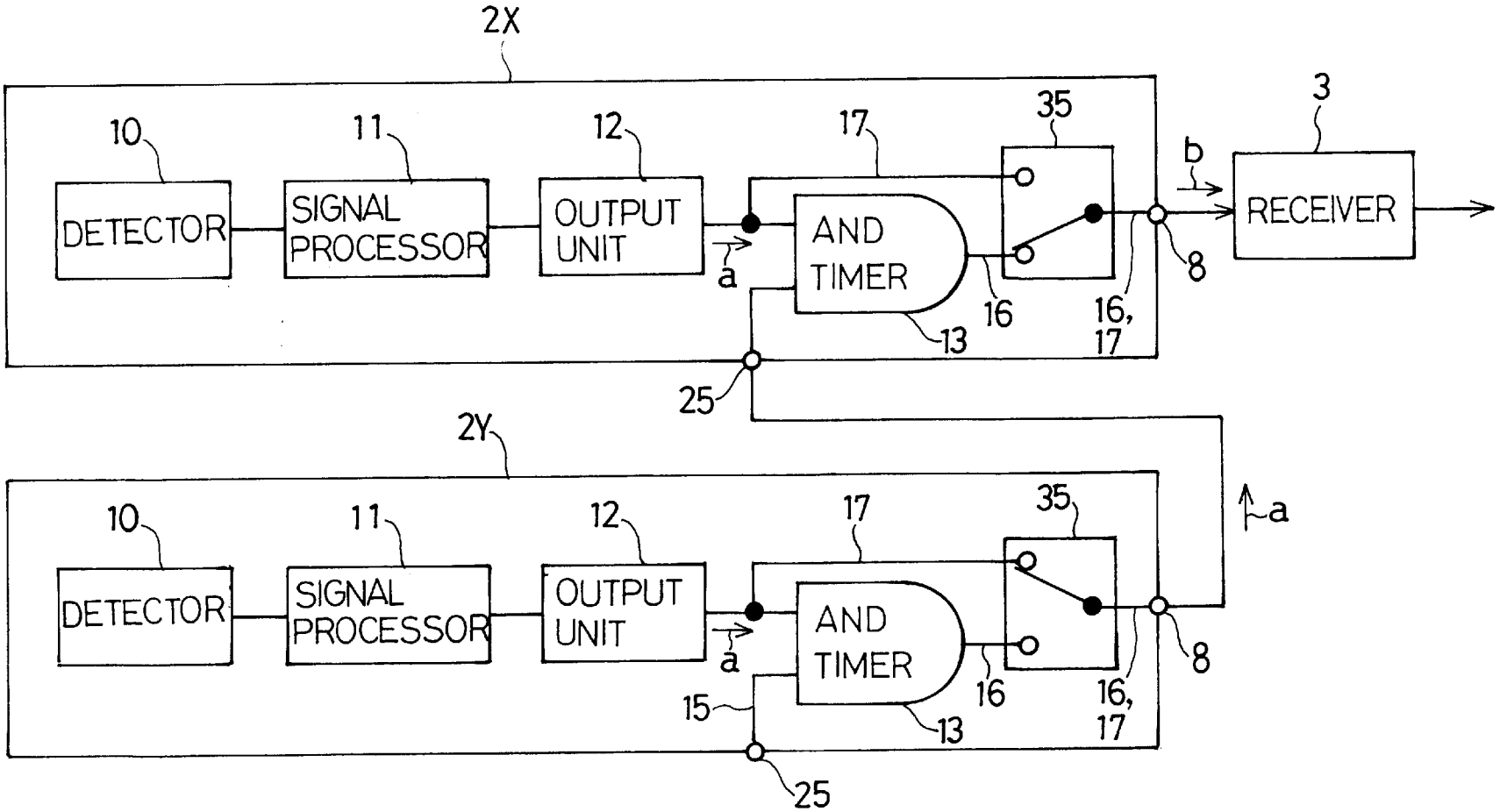
FIG. 8 is a circuit block diagram showing another example of structure of the PIR sensor.

A modified form of the first and second PIR sensors 2X and 2Y is shown in FIG. 8. In this modification shown in FIG. 8, each of the first and second PIR sensors 2X and 2Y includes a respective switch 35 interposed between an output end of the AND timer 13 and the output terminal 8 for the warning signal b so that the output terminal 8 for the warning signal b can be selectively switched by the switch 35 over to one of the output end of the AND timer 13 and an output end of the output unit 12 wherefore one of the first output path 16 and the second output path 17 can be selectively utilized. Other component parts of each of the first and second PIR sensors 2X and 2Y are substantially identical with those shown in FIG. 2.

In the modification shown in FIG. 8, the first and second PIR sensors 2X and 2Y are so connected that the AND timer 13 of the first PIR sensor 2X can be utilized. In other words, in the first PIR sensor 2X, the output terminal 8 for the warning signal b is connected by the switch 35 with the output end of the AND timer 13 through the first output path 16 and, on the other hand, in the second PIR sensor 2Y, the output terminal 8 for the warning signal b is connected by the switch 35 with the output end of the output unit 12 through the second output path 17. The switch 35 referred to above may be, for example, a manually operable switch. Also, the output terminal 8 of the second PIR sensor 2Y is connected with the input path 15 of the first PIR sensor 2X.

Accordingly, the detection signal a from the output unit 12 of the first PIR sensor 2X and the detection signal a from the output unit 12 of the second PIR sensor 2Y are inputted to the AND timer 13 in the first PIR sensor 2X, and an output signal from the AND timer 13 in the first PIR sensor 2X is outputted as the warning signal b from the output terminal 8 of the first PIR sensor 2X and is then transmitted to the receiver 3.

It is to be noted that both of the AND timer 13 and the switch 35 employed in the second PIR sensor 2Y can be dispensed with, in which case the output end of the output unit 12 of the second PIR sensor 2Y has to be connected directly with the output terminal 8 of the second PIR sensor 2Y.

Where the first and second PIR sensors 2X and 2Y are desired to be used independently, the switch 35 has to be set in position to connect the output terminal 8 with the output unit 12 to disable the AND timer 13 and to open the input terminal 25. In this way, the first and second PIR sensors 2X and 2Y can be used as a standard sensor with no AND logic circuit employed, thereby increasing the versatility.

Figure 9:
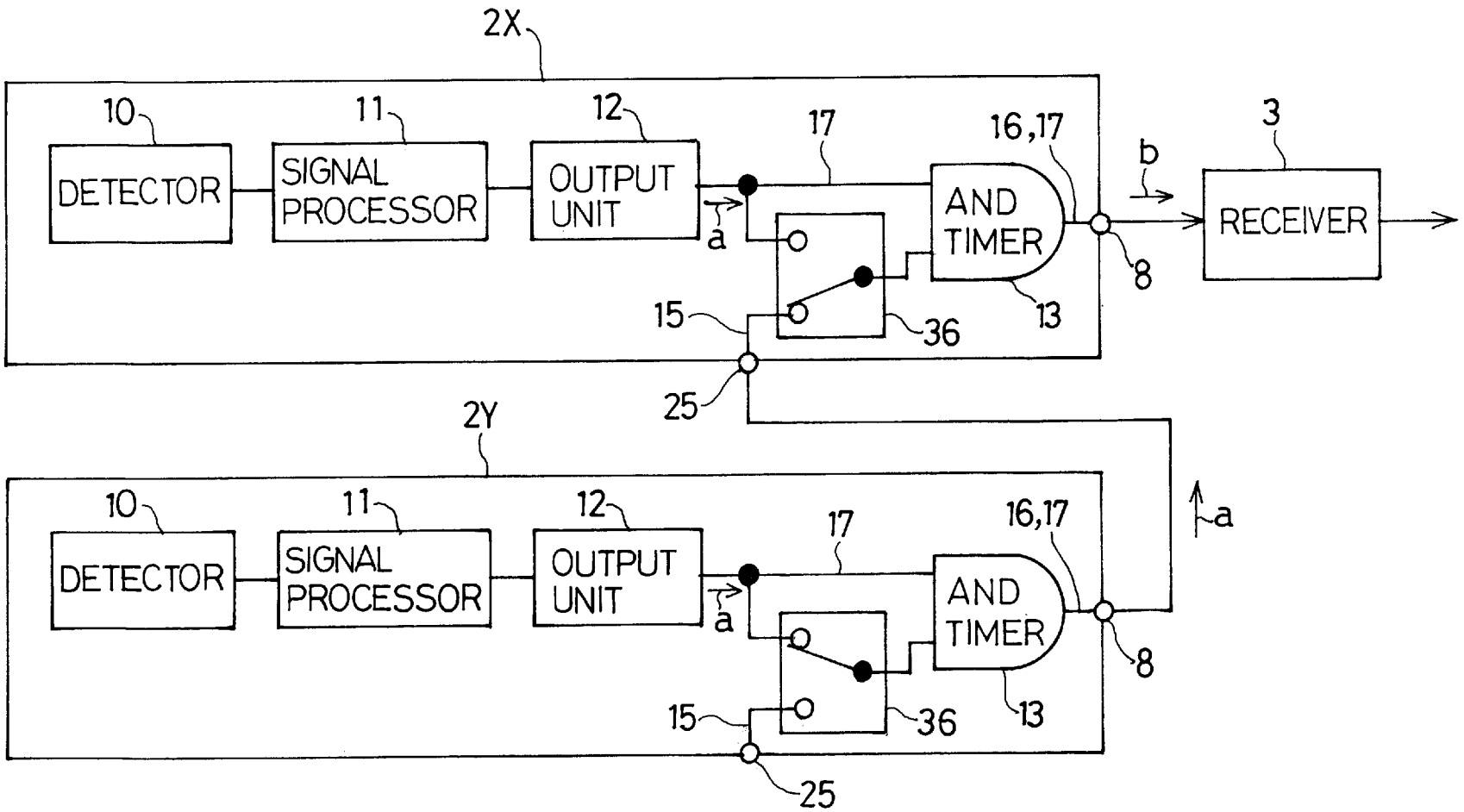
FIG. 9 is a circuit block diagram showing a further example of structure of the PIR sensor.

Another modified form of the first and second PIR sensors 2X and 2Y is shown in FIG. 9. In this modification shown in FIG. 9, each of the first and second PIR sensors 2X and 2Y includes a switch 36 disposed on the input path 15 connected with the second input terminal of the AND timer 13 so that the second input terminal of the AND terminal 13 can be selectively connected with one of the output end of the output unit 12, connected with the first input terminal of the AND timer 13, and the input path 15. Other component parts of each of the first and second PIR sensors 2X and 2Y are substantially identical with those shown in FIG. 2. In the modification shown in FIG. 9, first and second PIR sensors 2X and 2Y are so connected that the AND timer 13 employed in the first PIR sensor 2X can be utilized.

More specifically, in the first PIR sensor 2X, the first input terminal of the AND timer 13 is connected with the input path 15 through the switch 36 and, on the other hand, in the second PIR sensor 2Y, the first and second input terminals of the AND timer 13 are connected with each other through the switch 36. Accordingly, in the second PIR sensor 2Y, the detection signal a outputted from the output unit 12 is transparently outputted from the output terminal 8 through the second output path 17 passing through the AND timer 13. The output terminal 8 of the second PIR sensor 2Y is connected with the input path 15 of the first PIR sensor 2X. Accordingly, the detection signal a from the output unit 12 of the first PIR sensor 2X and the detection signal a from the output unit 12 of the second PIR sensor 2Y are both inputted to the AND timer 13 in the first PIR sensor 2X and an output signal from this AND timer 13 in the first PIR sensor 2X is outputted as the warning signal b from the output terminal 8 through the first output path 16 and is then transmitted to the receiver 3.

It is to be noted that both of the AND timer 13 and the switch 36 employed in the second PIR sensor 2Y can be dispensed with, in which case the output end of the output unit 12 of the second PIR sensor 2Y has to be connected directly with the output terminal 8 of the second PIR sensor 2Y.

Even in the modified form shown in FIG. 9, where the first and second PIR sensors 2X and 2Y are desired to be used independently, the switch 36 has to be set in position to connect the output unit 12 with the second input terminal of the AND timer 13 so that the detection signal a outputted from the output unit 12 can be outputted from the output terminal 8 through the second output path 17 passing through the AND timer 13. In this way, the first and second PIR sensors 2X and 2Y can be used as a standard sensor with no AND logic circuit employed, thereby increasing the versatility.

Figure 10:
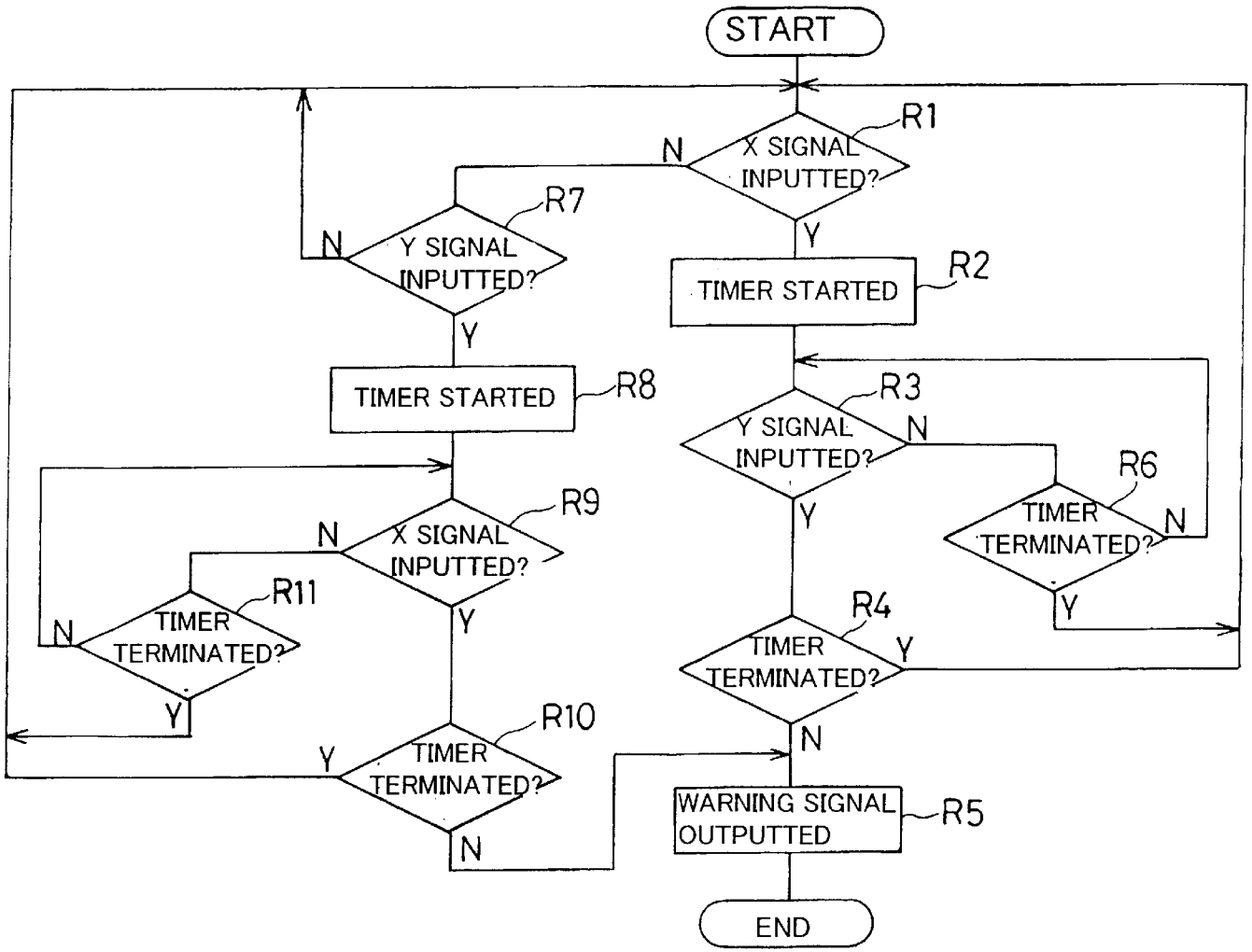
FIG. 10 is a flow chart showing another sequence of operation of the timer-equipped logic circuit (AND timer) employed in the intruder detecting apparatus.

FIG. 10 illustrates the flow chart showing a different function of the AND timer 13. In this example, even when the same signal X or Y is inputted twice, the timer is not restarted and, when, for example, the X signal, which is the detection signal from the output unit 12 of the first PRI sensor 2X, is first inputted, it is operated to wait for the Y signal, which is the detection signal from the output unit 12 of the second PIR sensor 2Y, to be inputted until the predetermined time preset in the timer elapses. In other words, when, for example, the X signal is inputted, the timer starts its counting operation at that time at steps R1 and R2 shown in FIG. 10, and when the Y signal is inputted before the predetermined time, for example, five seconds preset in the timer passes at steps R3 and R4, the warning signal b is outputted from the AND timer 13 at step R5, which warning signal b is subsequently transmitted to the receiver 3 so that the receiver 3 can issue an alarm in response to receipt of the warning signal b.

Also, after the X signal has been inputted, and before the predetermined time preset in the timer elapses, wait is made until the Y signal is inputted regardless of whether or not the X signal is inputted at steps R3 and R6 of FIG. 10, unlike the flow shown in FIG. 3. Where the Y signal is not inputted within the predetermined time preset in the timer as determined at step R6, or where the Y signal is inputted after the passage of the predetermined time preset in the timer at step R4, the flow returns to step R1 to repeat the above described operation.

The foregoing operation equally takes place even when the Y signal is first inputted. In other words, when the Y signal is first inputted at steps R1 and R7 of FIG. 10, the timer starts its counting operation at that time at step R8. When the X signal is inputted before the predetermined time preset in the timer passes as determined at steps R9 and R10, the warning signal b is outputted from the AND timer 13 at step R5 and is then transmitted to the receiver 3 to allow the receiver 3 to issue the alarm in response to receipt of the warning signal b. Also, after the Y signal has been inputted and before the predetermined time preset in the timer passes, wait is made until the X signal is inputted regardless of whether or not the Y signal is again inputted as determined at steps R9 and R10. Where the X signal is not inputted within the predetermined time preset in the timer as determined at step R11, or where the X signal is inputted after the passage of the predetermined time preset in the timer as determined at step R10, the flow returns to step R1 to repeat the above described operation.

Figure 11:
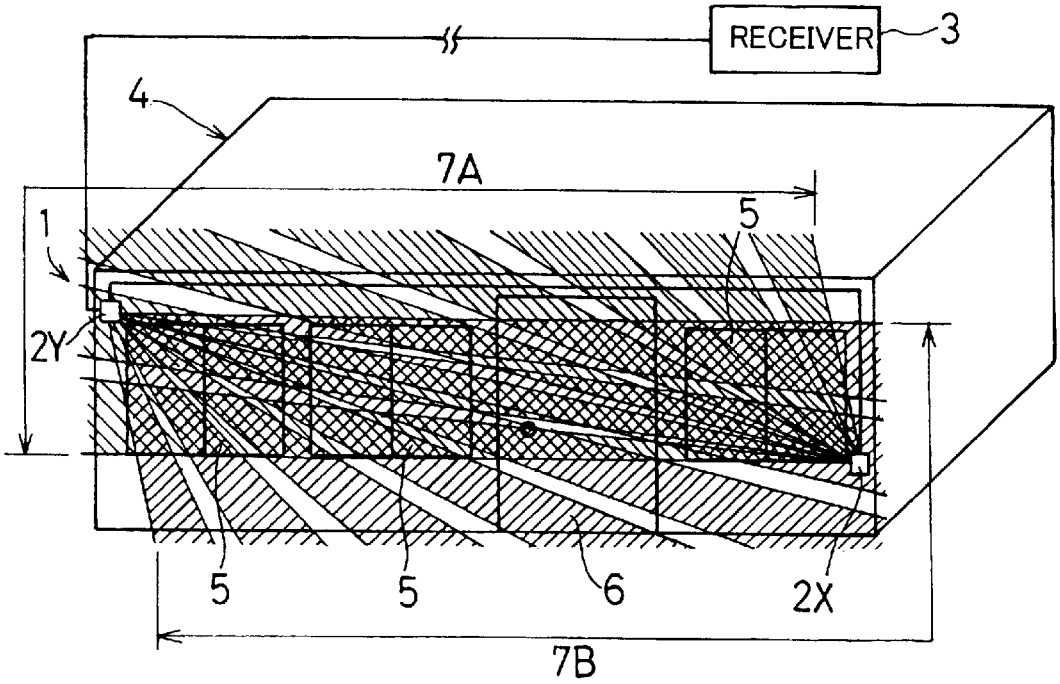
FIG. 11 is a schematic perspective view of the house, showing the intruder detecting system according to a second preferred embodiment of the present invention.

The intruder detecting system according to a second preferred embodiment of the present invention is shown in FIG. 11 in a schematic representation. Even the illustrated intruder detecting system, as is the case with the previously described embodiment, makes use of the intruder detecting apparatus 1 including the first and second PIR sensors 2X and 2Y for detecting the presence or absence of a intruder from one or more of the openings such as the windows 5 and the entrance 6 of the house 4. Also as is the case with the previously described embodiment, each of the first and second PIR sensors 2X and 2Y includes the semi-curtain shaped detection area 7A or 7B. However, this second embodiment of the present invention differs from the previously described first embodiment in that as shown in FIG. 11, the first PIR sensor 2X having the semi-curtain shaped detection area 7A oriented upward is disposed on one side of the wall 40 of the house 4 opposite to the side where the second PIR sensor 2Y having the semi-curtain shaped detection area 7B oriented downward is installed. The first and second PIR sensors 2X and 2Y employed in the second embodiment are positioned at the same respective heightwise levels as that in the previously described embodiment.

In the case of the second embodiment, by adjusting the respective positions for installation of the first and second PIR sensors 2X and 2Y, the overlapping area portion in which the respective semi-curtain shaped detection areas 7A and 7B for the first and second PIR sensors 2X and 2Y overlap each other can be restricted as desired with respect to not only the heightwise direction of the house 4, but also the transverse (horizontal) direction of the house 4 and, therefore, depending on the positions of the openings such as the windows 5 and the entrance 6 of the house 4, the detection area can be properly and accurately defined. Also, since the first and second PIR sensors 2X and 2Y of the same structure can be employed although one of them has to be held in a posture rotated 180° relative to the other of them, the second embodiment of the present invention does not require the use of two PIR sensors of different structure, thereby reducing the cost required for installation.

Figure 12:
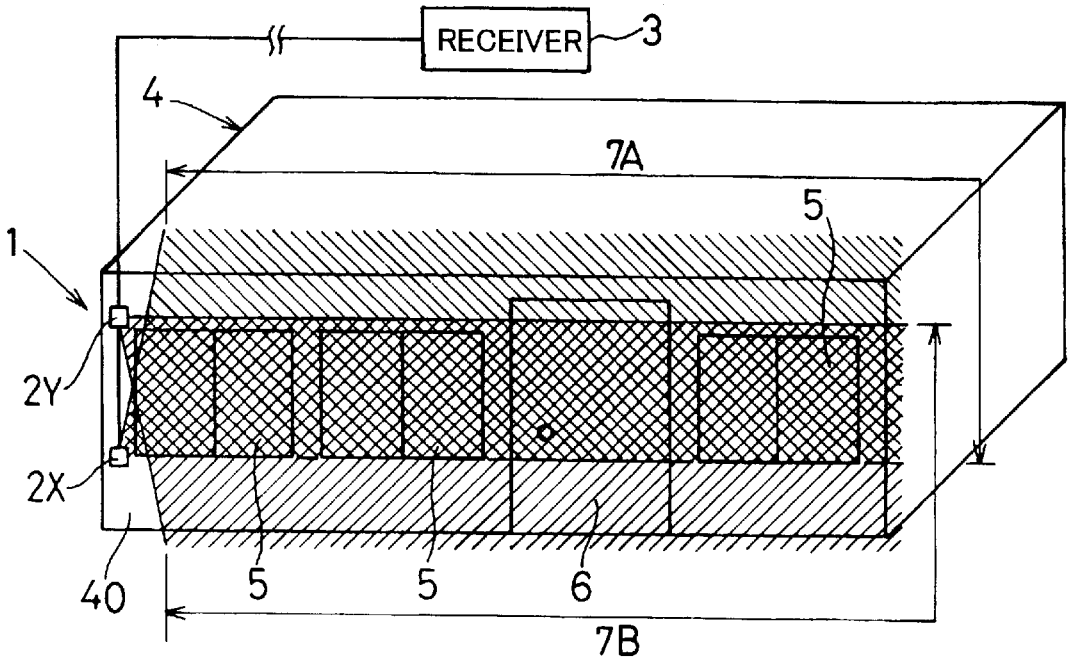
FIG. 12 is a schematic perspective view of the house, showing the intruder detecting system according to a third preferred embodiment of the present invention.

FIG. 12 illustrates the intruder detecting system according to a third preferred embodiment of the present invention. Even the illustrated intruder detecting system, as is the case with the previously described embodiment, makes use of the intruder detecting apparatus I including the first and second PIR sensors 2X and 2Y for detecting the presence or absence of a intruder from one or more of the openings such as the windows 5 and the entrance 6 of the house 4. However, the embodiment shown in FIG. 12 is different from the first embodiment in that in the embodiment of FIG. 12 the first and second PIR sensors 2X and 2Y define the respective curtain shaped detection areas 7A and 7B. Specifically, in the embodiment shown in FIG. 12, the curtain shaped detection areas 7A and 7B means a wall-like detection area extending in the vertical direction. The respective positions for installation of the first and second PIR sensors 2X and 2Y remains the same as those in the first embodiment described hereinbefore.

Even in the third embodiment, the intruder can be accurately detected in the manner similar to that in the first embodiment of the present invention. Other functions are similar to those in the first embodiment.

Figure 13:
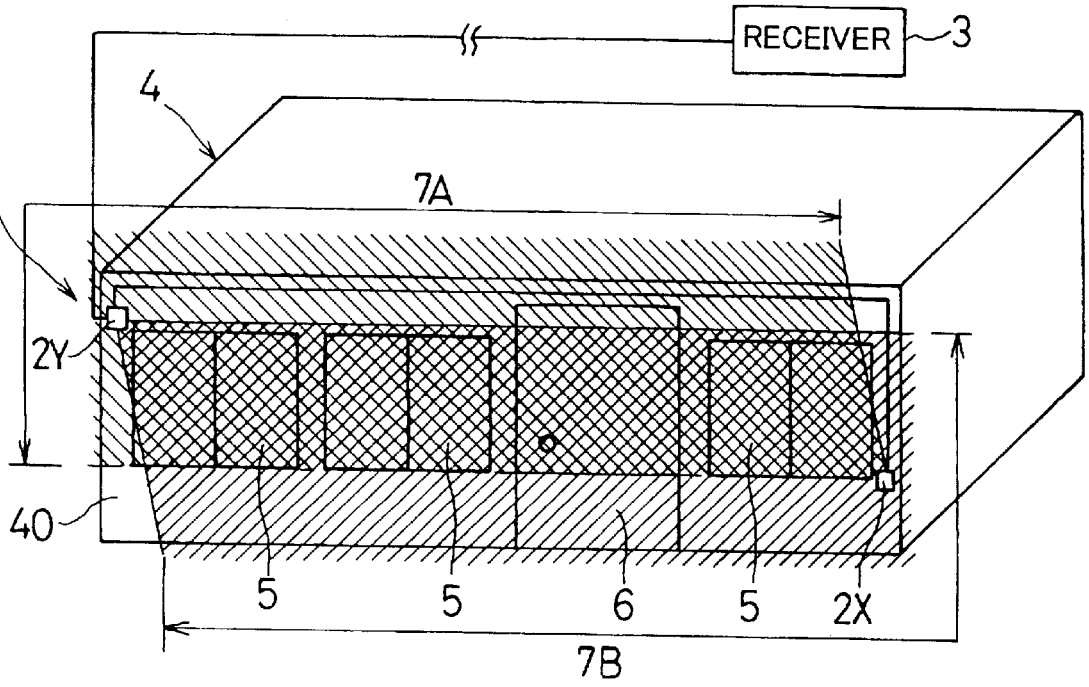
FIG. 13 is a schematic perspective view of the house, showing the intruder detecting system according to a fourth preferred embodiment of the present invention.

The intruder detecting system according to a fourth preferred embodiment of the present invention is shown in FIG. 13. Even the illustrated intruder detecting system, as is the case with the previously described embodiment, makes use of the intruder detecting apparatus 1 including the first and second PIR sensors 2X and 2Y for detecting the presence or absence of a intruder from one or more of the windows 5 and the opening such as the entrance 6 of the house 4. However, the embodiment shown in FIG. 13 is different from the first embodiment in that in the embodiment of FIG. 13 the first and second PIR sensors 2X and 2Y define the respective curtain shaped detection areas 7A and 7B and that the first PIR sensor 2X defining the upwardly oriented semi-curtain shaped detection area 7A is installed at one side of a transversely extending array of the windows 5 in the wall 40 of the house 4, which is opposite to the side thereof where the second PIR sensor 2Y is installed.

Even in this fourth embodiment, as is the case with the second embodiment shown in FIG. 11, by adjusting the respective positions for installation of the first and second PIR sensors 2X and 2Y, the overlapping area portion in which the respective semi-curtain shaped detection areas 7A and 7B for the first and second PIR sensors 2X and 2Y overlap each other can be restricted as desired with respect to not only the heightwise direction of the house 4, but also the transverse (horizontal) direction of the house 4 and, therefore, depending on the positions of the openings such as the windows 5 and the entrance 6 of the house 4, the detection area can be properly and accurately defined. Also, as is the case with the second embodiment, the first and second PIR sensors 2X and 2Y of the same structure can be employed in this fourth embodiment.

Figure 14:
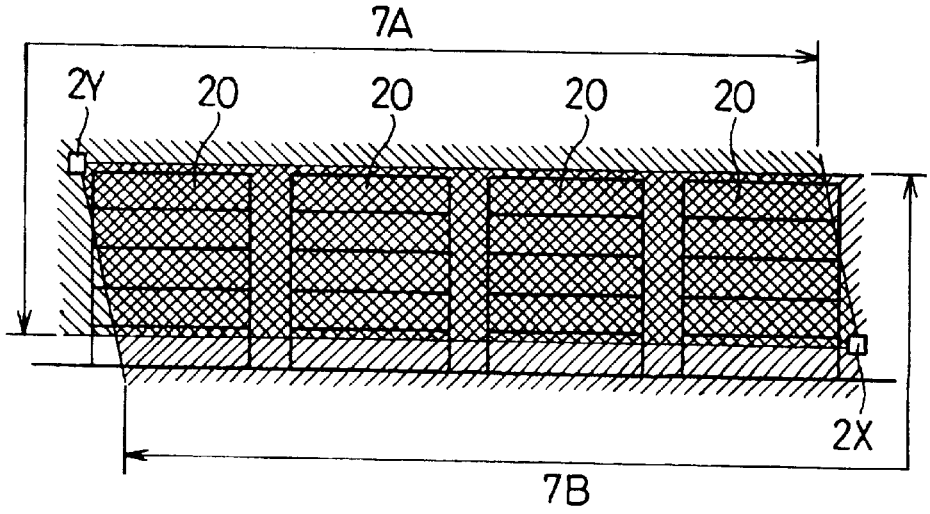
FIG. 14 is a schematic front elevational view, showing an application of the foregoing embodiment of the present invention to a plurality of warehouses built in side-by-side fashion in one direction for detection of a intruder.

It is to be noted that although in any one of the first to fourth embodiments of the present invention, based on the assumption that the object to be watched is the openings such as the windows 5 and the entrance 6 of the single house 4, the detection areas 7A and 7B have been defined, the present invention is not limited thereto, but arrangement may be made as shown in FIG. 14 in which all of entrances of a transverse array of plural warehouses or storage houses 20 are covered by the overlapping area portion of the respective detection areas 7A and 7B defined by the first and second PIR sensors 2X and 2Y.

Figure 15:
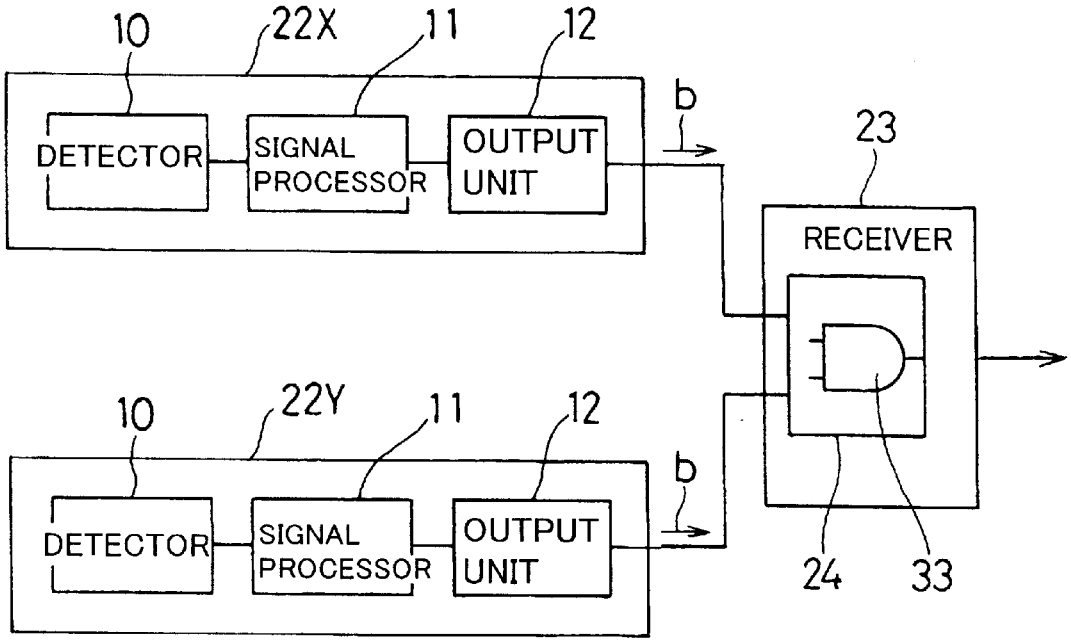
FIG. 15 is a circuit block diagram showing the intruder detecting system according to a fifth preferred embodiment of the present invention.
Figure 16:
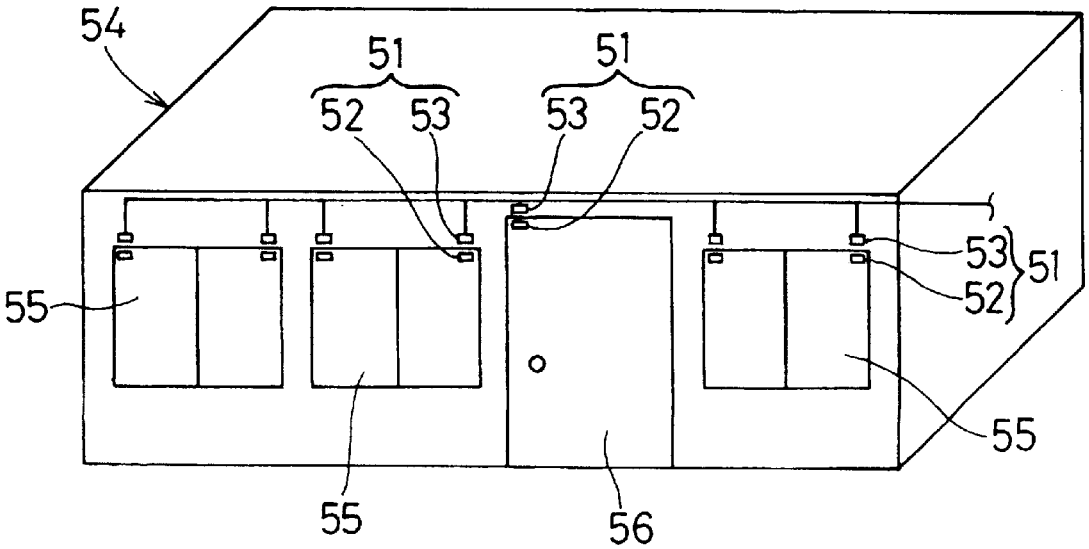
FIG. 16 is a schematic perspective view of the house showing one prior art intruder detecting apparatus utilizing magnet switches.
Figure 17:
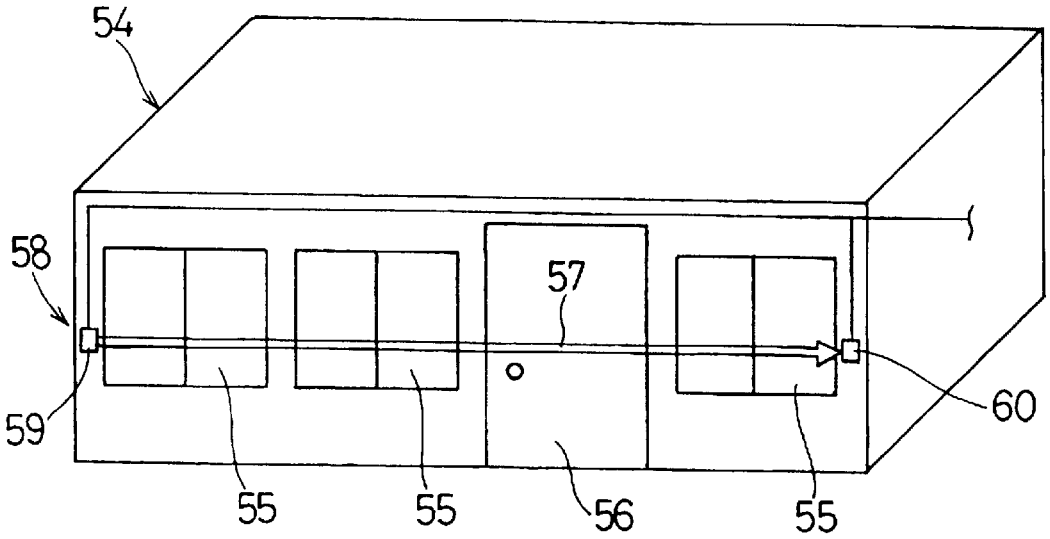
FIG. 17 is a schematic perspective view of the house showing another prior art intruder detecting apparatus utilizing infrared beam sensors.
Figure 18:
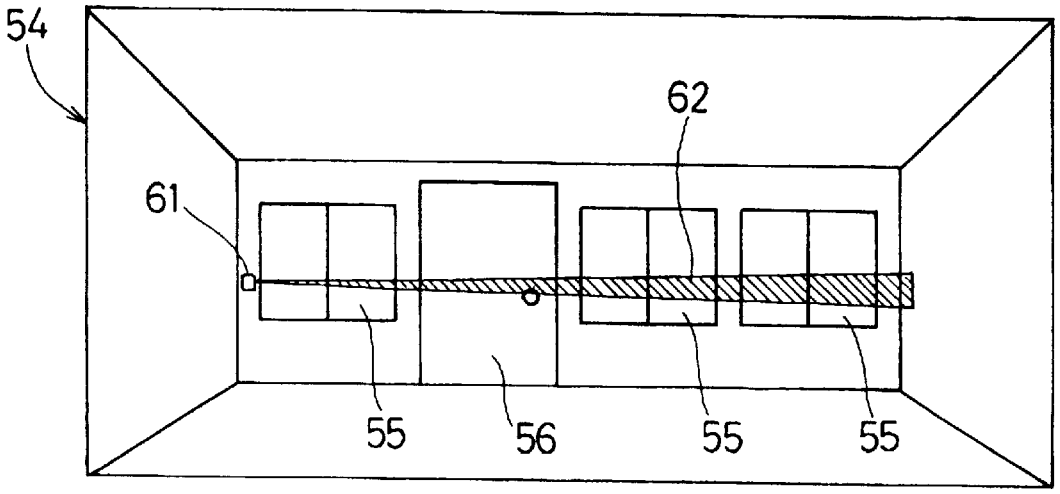
FIG. 18 is a schematic front elevational view of the house showing a further prior art intruder detecting apparatus utilizing the PIR sensor.
Figure 19:
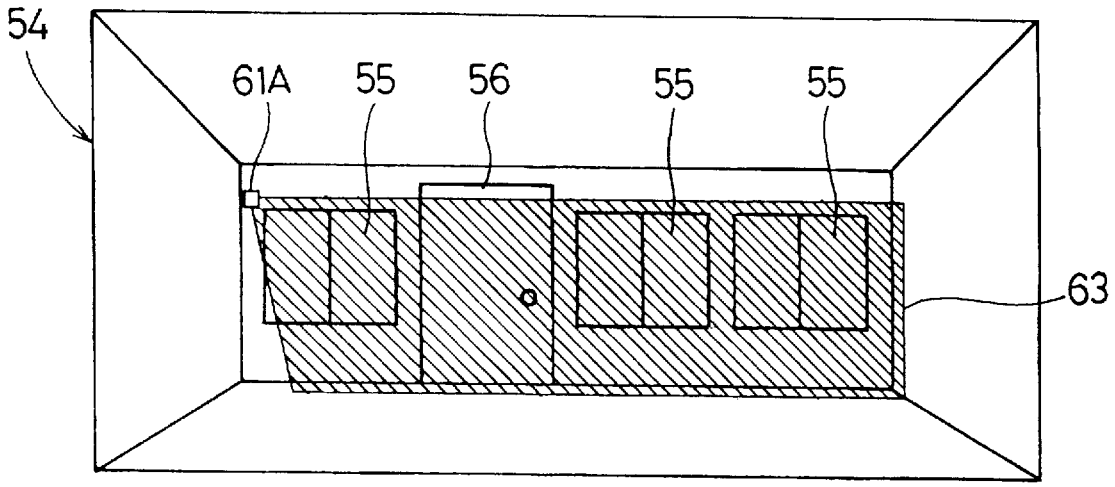
FIG. 19 is a schematic front elevational view of the house showing a still further prior art intruder detecting apparatus utilizing the PIR sensors.
Figure 20:
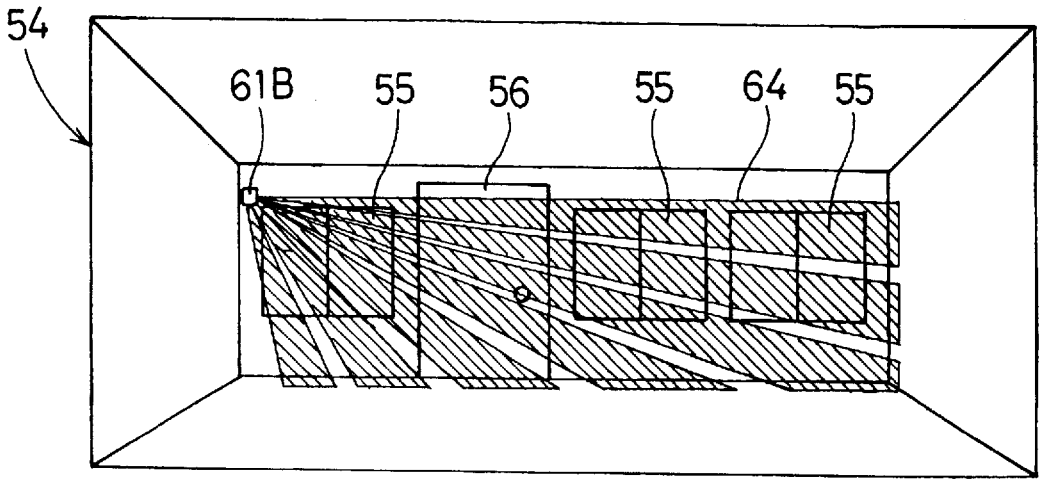
FIG. 20 is a schematic front elevational view of the house showing a yet further prior art intruder detecting apparatus utilizing the PIR sensor.

Referring now to FIG. 15, there is shown a circuit block diagram of the intruder detecting apparatus 21 that is used in the practice of the intruder detecting system according to a fifth preferred embodiment of the present invention. Even this intruder detecting apparatus 21 includes first and second PIR sensors 22X and 22Y and a receiver 23. Each of the first and second PIR sensors 22X and 22Y may be of any known PIR sensor and includes a detector 10 in the form of a pyroelectric element or the like, a signal processing unit 11 for signal-processing a detection output from the detector 10, and an output unit 12 for outputting the signal, processed by the signal processing unit 11, as a warning signal b. The AND timer 13, the second output path 17 and the input path 12, all of which are employed in each of the first and second PIR sensors 2X and 2Y used in any one of the previously described embodiments of the present invention are not employed here.

Instead, a receiver unit 24 of the receiver 23 for receiving the warning signal b from the output unit 12 of each of the first and second PIR sensors 22X and 22Y is provided with an AND timer 33 having a function substantially identical with that of the AND timer 13 employed in any one of the previously described embodiments. In other words, this AND timer 33 has a function of outputting a signal that is used to generate an alarm, when both of the first and second PIR sensors 22X and 22Y perform a respective detecting operation within a predetermined time, for example, five seconds, that is, when the warning signals b based on detection are supplied from the first and second PIR sensors 22X and 22Y to the AND timer 33 within the predetermined time.

The respective positions for installation of the first and second PIR sensors 22X and 22Y may be similar to those employed in any one of the previously described embodiments of the present invention. Also, the detection area defined by each of the first and second PIR sensors 22X and 22Y may be either a semi-curtain shaped detection area or a curtain shaped detection area.

Even in this fifth embodiment of the present invention, the first and second PIR sensors 22X and 22Y are so positioned and so installed that the overlapping area portion of the respective detection areas of the first and second PIR sensors 22X and 22Y covers the openings such as the windows and the entrance of the house or building, wherefore the intruder can be accurately and correctly detected without an erroneous alarm which would otherwise be generated under the influence of the external disturbance light and/or the small size animal intrudering the detection area and installation can easily be accomplished. Also, in this fifth embodiment, since the AND timer 33 is incorporated in the receiver 23, any known PIR sensor having a standard function can be employed for each of the first and second PIR sensors 22X and 22Y.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A intruder detecting method which comprises the steps of:

providing a first sensor having an detection area defined on the front side of an object to be watched and a portion upwardly of the object to be watched, and a second sensor having an detection area defined on the front side of the object to be watched and a portion downwardly of the object to be watched; and generating an alarm when the first and second sensors perform a detecting operation simultaneously within a predetermined time.

2. A intruder detecting apparatus which comprises:

a first sensor having an detection area defined on the front side of an object to be watched and a portion upwardly of the object to be watched;

a second sensor having an detection area defined on the front side of the object to be watched and a portion downwardly of the object to be watched;

a timer-equipped logic circuit provided in at least one of the first and second sensors;

an output path provided in at least the other of the first and second sensors having a detector and operable to output a detection signal from such detector to an external circuit; and said timer-equipped logic circuit being operable to generate a warning signal when the timer-equipped logic circuit receives within a predetermined time, a detection signal, fed from a detector within said one of the first and second sensors and a detection signal outputted through the output path of the other of the first and second sensors.

3. The intruder detecting apparatus as claimed in claim 2, further comprising an output path provided in said one of the first and second sensors provided with the timer-equipped logic circuit, for outputting the detection signal as a warning signal.

4. The intruder detecting apparatus as claimed in claim 2, wherein each of the first and second sensors is disposed on one side of the object to be watched.

5. The intruder detecting apparatus as claimed in claim 2, wherein one of the first and second sensors is disposed on one side of the object to be watched and the other of the first and second sensors is disposed on the opposite side of the object to be watched.

6. The intruder detecting apparatus as claimed in claim 2, wherein said one of the first and second sensors provided with the timer-equipped logic circuit includes an output terminal connected with one of an output end of the timer-equipped logic circuit and a switch operable to selectively connect one of an output signal from the timer-equipped logic circuit and a detection signal from a detector to the output terminal.

7. The intruder detecting apparatus as claimed in claim 2, wherein said one of the first and second sensors provided with the timer-equipped logic circuit includes a switch for selectively inputting one of a detection signal from the other of the first and second sensors and a detection signal from a detector of such one of the first and second sensors to one of two input terminals of the timer-equipped logic circuit, the other of the two input terminals of the timer-equipped logic circuit being inputted with the detection signal from the detector of such one of the first and second sensors.

8. A intruder detecting apparatus which comprises:

a first sensor having an detection area defined on the front side of an object to be watched and a portion upwardly of the object to be watched;

a second sensor having an detection area defined on the front side of the object to be watched and a portion downwardly of the object to be watched;

a receiver for generating an alarm in response to receipt of a warning signal based on detection from the first and second sensors;

a timer-equipped logic circuit provided in the receiver for generating the alarm when the timer-equipped logic circuit receives respective warning signals from the first and second sensors simultaneously within a predetermined time.

9. A intruder detecting sensor having a curtain shaped or semi-curtain shaped detection area, said sensor comprising:

a timer-equipped logic circuit adapted to receive a detection signal, as one of input signals, from a detector provided in the sensor, and operable to generate a warning signal when the timer-equipped logic circuit receives such one of the input signals and the other of the input signals simultaneously within a predetermined time;

an input path for inputting an input signal from an external circuit to the timer-equipped logic circuit as the other of the input signals; and an output path for outputting the detection signals as the warning signal.

10. The intruder detecting sensor as claimed in claim 9, further comprising a switch for selectively outputting one of an output signal from the timer-equipped logic circuit and an output signal from the detector as the warning signal.

11. The intruder detecting sensor as claimed in claim 10, further comprising a switch disposed on the input path for selectively outputting such one of the input signals and an output signal from the external circuit to the timer-equipped logic circuit as such other of the input signals.

* * * * *